US005139581A

United States Patent [19]

Grimm et al.

[11] Patent Number: 5,139,581

[45] Date of Patent: Aug. 18, 1992

[54] METHOD OF MAKING A METAL EARTH WORKING IMPLEMENT

[75] Inventors: William L. Grimm, Wheaton, Ill.; William A. Stewart, Hamilton, Canada

[73] Assignee: Case Corporation, Racine, Wis.

[21] Appl. No.: 592,419

[22] Filed: Oct. 3, 1990

[51] Int. Cl.[5] ..... C21D 7/06; C21D 8/00

[52] U.S. Cl. ..... 148/632; 148/649; 148/653

[58] Field of Search ..... 148/12 R, 12.4

[56] References Cited

U.S. PATENT DOCUMENTS 4,379,745 4/1983 Polizzotti et al. ..... 148/12 E 4,424,083 1/1984 Polizzotti et al. ..... 148/12 E 4,837,114 6/1989 Hamada et al. ..... 148/3

*Primary Examiner*—Deborah Yee

*Attorney, Agent, or Firm*—Dykema Gossett

[57] ABSTRACT

A method for producing moldboard for use with plows and the like employs a process whereby the moldboards are shot peened under closely controlled conditions to form a textured, pocked contour across the working surface of the moldboard. This surface structure allows for several prior art steps to be eliminated, and also facilitates the scouring of the moldboard when it is first used thereby allowing the moldboard to scour until a working finish is established on the working surface of the moldboard.

39 Claims, 3 Drawing Sheets

METHOD OF MAKING A METAL EARTH WORKING IMPLEMENT

BACKGROUND OF THE INVENTION

This application generally relates to earth working implements and deals more specifically with a process of making a moldboard for an earth tilling plow.

TECHNICAL FIELD

Moldboard plows are well-known in the art of earth tillage and typically employ one or more plow elements (called plow bottoms) attached to a plow frame. The primary purpose of the plow bottom is to cut, lift and turn the soil (furrow) as the plow bottom is pulled along by the tractor. The plow bottom is typically comprised of two main components: the plowshare and the moldboard. The plowshare is the bottom and leading edge portion of the Plow bottom which cuts the furrow from the ground and begins the upward movement of the furrow toward the moldboard. Additionally, the plowshare controls the depth at which the plow bottom cuts through the ground. The moldboard is a curved metal plate attached adjacent to the plowshare which lifts and turns the furrow.

Because each portion of the plow bottom performs a separate and distinct function, each portion must be designed from materials which permit effective operation and longevity of use. For example, because one of the primary functions of the plowshare is to cut the furrow from the ground and begin its upward delivery to the moldboard, it must be capable of maintaining a sharp cutting edge for cutting through the furrow. Also, it must be properly contoured to control the plow bottom cutting depth. The moldboard, on the other hand, serves primarily to turn the furrow. This is accomplished by "rolling" the furrow as the moldboard displaces the furrow upwardly and laterally. In order for the moldboard to properly perform its "rolling" function, the furrow must move across the earth working surface of the moldboard without sticking. If the furrow moves across the surface of the moldboard without sticking, the moldboard is said to "scour." If, for some reason, proper scouring does not take place, the furrow does not move across the moldboard, but rather sticks to it thereby causing an unacceptable condition (usually resulting in the inability of the moldboard to turn the furrow).

In the past, much attention has been devoted to developing each moldboard design to suit specific soil conditions. This effort resulted in a family of moldboard designs, each design specifically matched to accommodate scouring in particular soil conditions. For example, in sticky soils where scouring is particularly a problem, moldboards are constructed from individual slats which minimize soil contact area thereby increasing the pressure exerted by the soil against the working surface of the moldboard. This increase in pressure results in improved scouring.

Although moldboard design is an important factor in promoting scouring, it is not the only factor influencing souring. It is well known in the art that tractor speed influences scouring. For example, a plow bottom which is being pulled through the soil at two miles an hour may not scour properly at that speed but may scour properly when the tractor speed is increased to four or six miles per hour. Until recently, however, increasing the ground speed of the tractor was not a viable option because the horsepower per plow bottom ratio was closely matched (large powerful tractors were expensive and rare forty years ago). This factor prevented the tractor from achieving ground speeds great enough to overcome scouring problems caused by moldboards which were grossly mismatched to the soil conditions.

Because the character of the earth working surface on the moldboard plays an important factor in permitting scouring, the surface roughness or "finish" placed on the working surface of the moldboard during manufacture is important. For example, it is common for the working surface of the moldboards to be sanded, during manufacture, in the direction which approximates the path which the furrow will travel when crossing the moldboard surface. Thus, when a new moldboard is first placed in the soil, the "scratches" left in the moldboard surface from the directional sanding process promote the movement of the furrow across the face of the moldboard (i.e., promote scouring). After a short period of use, the directional finish scratches placed in the face of the moldboard plow are "polished" out by the scouring process and the moldboard is said to have a "land polish." This land polish must be preserved by placing grease or some other anti-rust compound on the moldboard and share. If the land polish is not in some way preserved, the plow bottom may rust and not scour during its next use. If the moldboard does rust, it can either be hand polished or moved to soil which scours easily (e.g., sand or extremely dry soil) and dragged through the soil until a good land polish is re-established.

Prior to performing the above directional sanding process, it is common to remove the material known as mill scale from the moldboard stock. During fabrication of metal, particularly steel, thermal conditions promote the formation of iron oxide (i.e. mill scale) on the outer surfaces of the metal. It is generally desirable to remove this scale for the following three reasons: first, the mill scale would otherwise contaminate the sanding belt and associated machinery used in the directional sanding operation thereby necessitating frequent belt replacement and increased machine maintenance; second, if left on the moldboard stock, the scale would tend to separate from the moldboard during the heat treating process thereby contaminating the heat treating apparatus; and third, and most important, the low thermal conductivity of the scale decreases the rate at which heat can be removed from the moldboard during quenching. This adverse affect on quenching, depending on the quantity and character of the scale, can negatively affect the uniformity of hardness and maximum achievable hardness of the moldboard. In order to avoid the above undesirable conditions, mill scale is typically removed from the moldboard stock before commencing the directional sanding operation.

Another purpose of sanding is to remove the layer of material known as the decarburization layer from the stock used to make the moldboards. During the fabrication of steel, thermal conditions promote decarburization of the surfaces of the metal. Generally, the carbon content of steel must be of sufficient concentration and uniformity before the steel can be heat treated to an acceptable hardness. However, when decarburization occurs, carbon is lost from the surface layer of the metal (but not from the underlying body portion). As a result of this decarburization, the decarburized layer will not harden significantly, leaving the surface metal softer than the underlying body. Grinding before heat treating removes the decarburized layer.

Although directional sanding, as mentioned above, does allow the plow bottom to properly scour when it is pulled through the soil for the first time after manufacture, the process of directionally sanding the moldboard is an expensive and time consuming step in the overall process of producing the moldboard. Specifically, directional sanding typically employs large specialized machinery which is expensive to purchase and costly to maintain. Moreover, in order to effectively carry out the directional sanding process, the metal must first be straightened and cleaned of mill scale. The straightening is necessary so that the directional sanding will be uniform across the metal surface and the necessity of cleaning has already been discussed. Accordingly, it can be seen that the directional sanding step and the necessary preconditioning steps involve a substantial amount of time, money and machinery.

Accordingly, it is a primary object of the present invention to decrease the overall time and expense associated with producing moldboards for use on moldboard plow bottoms.

It is a feature of this invention to disrupt the metal surface of the metal stock (without sending) which forms the earth working surface of the moldboard. The disrupting of this surface is conducted in a controlled manner thereby forming a predetermined surface roughness and texture.

It is an advantage of this invention that by forming a predetermined surface roughness and texture on the working surface of the moldboard, the moldboard will properly scour when first placed in the soil, thereby allowing the moldboard to be used long enough to achieve a proper land polish. By disrupting the moldboard working surface to achieve a predetermine surface roughness and texture, three time and cost intensive processing steps are replaced by one relatively simple step which reduces the cost associated with producing moldboard plows.

SUMMARY OF THE INVENTION

Accordingly, one aspect of the present invention provides a method of making earth working implements which are capable of scouring which are not finish sanded during manufacture. The implements are made form a metal article having at least one earth working surface. The method comprises the steps of: (A) disrupting the earth working surface of the metal article thereby forming a controlled surface roughness across the earth working surface, (B) hardening the metal article having the controlled surface roughness placed on it in step (A), and (C) forming the metal article to conform to the requirements of the earth working implement, wherein the roughened surface of the metal article forms an earth working surface capable of scouring. The method preferably includes cutting the metal article from a sheet to produce sheet metal blanks and tempering the hardened metal article to improve its resistance against cracking. The disrupting step is preferably implemented by shot peening the earth working surface to achieve a surface roughness in the general range of 240–310 RMS. The shot peening step is preferably conducted using shot in the general range of S230 through S330.

The hardening of step (B) preferably comprises the substeps of: immersing the shot peened metal article having the controlled surface roughness into a molten salt bath for austenitization, and then quenching the shot peened metal article having the controlled surface roughness. The formed metal implement is placed in an earthen environment for which it is designed, and the earth is worked across the roughened working surface of the implement to achieve a working finish.

In addition to the above method, the present invention further provides an implement for working the earth which is capable of being finish polished during use. The implement comprises a metal article having a hardened body and at least one working surface layer. The working surface layer includes a textured finish of predetermined roughness. The textured finish is positioned such that, during use, earth is passed across the textured finish. In this manner, the working surface is worn away exposing and polishing a surface of the hardened body to produce a working finish on the surface of the hardened body. The metal article is preferably made of heat treatable steel and the hardened body preferably has a Rockwell body surface hardness in the general range of 47–51 and a Rockwell body through hardness of not generally less than 47.

Another aspect of the present invention includes an earth-engaging plow having self-finishing moldboards. The plow comprises a frame structure to be pulled behind a tractor and at least one moldboard attached to the frame. The moldboard is adapted to engage and work the earth and has a hardened steel body and at least one earth working surface. The earth working surface is adapted to engage the ground as the frame is pulled behind the tractor. The earth working surface includes a textured finish made in accordance with the methods of the present invention. The textured finish permits the earth to pass across the earth working surface with sufficient velocity to allow the ground to polish the earth working surface. This in turn produces a surface which is suitable to support scouring.

The earth working implement and method of forming a self-finishing friction surface on such implements of this invention will now be described in terms of a preferred embodiment of a moldboard plow. It will be understood by a person skilled in the art, however, that the disclosed invention has other valuable applications, particularly with respect to other earth working or tillage equipment which require scouring. Thus, the description herein of a moldboard plow and method of making same is not intended to be limiting, except for the unique advantages of the present invention for such an application.

These, together with other objects and advantages, will become more apparent in connection with the details of the invention as more fully hereinafter described and claimed.

BRIEF DESCRIPTION OF THE DRAWINGS

In the accompanying drawings, where like reference numerals refer to similar components in the various embodiments and features.

DETAILED DESCRIPTION OF THE PREFERRED EMBODIMENTS

Figure 1:
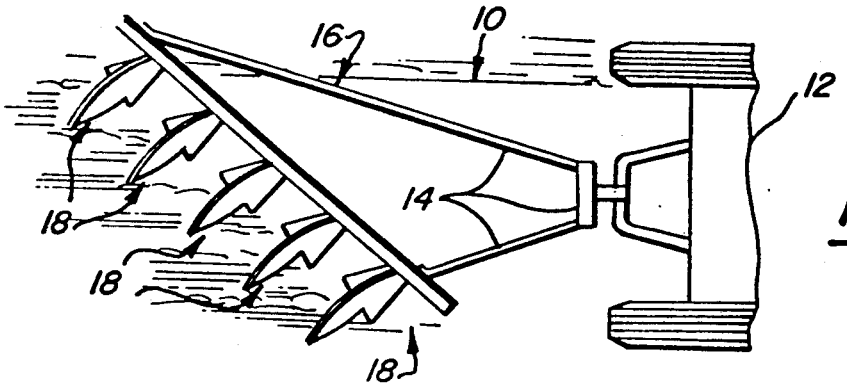
FIG. 1 is a partial top plan view of a tractor pulling a conventional moldboard plow.

Referring now to FIG. 1 of the drawings, moldboard plow 10 is one of the most widely used earth tillage implements for plowing the earth. Plow 10 is typically pulled through the earth via tractor 12 or similar prime mover. Plow 10 is comprised of any number of beam members 14 which are arranged to form frame 16. Attached to one or more beam members 14 of frame 16 are one or more plow bottoms 18. The primary purpose of plow bottom 18 is to till the earth. Tilling is comprised of cutting a furrow from the earth, and turning the furrow. The furrow is generally turned (rolled upside down) by virtue of the forces which are imparted to it via the moldboard. The moldboard turns the furrow by displacing the furrow vertically and laterally.

Figure 2:
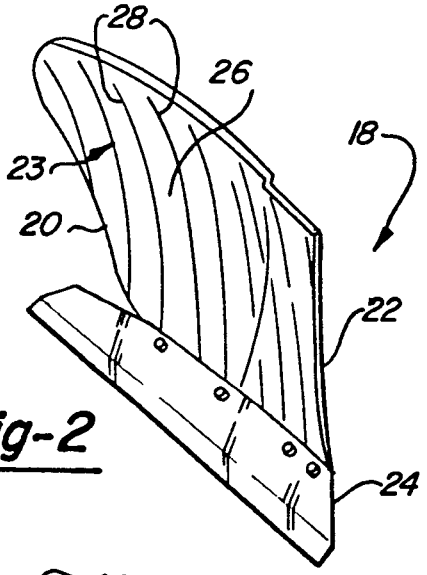
FIG. 2 is a side view of a plow bottom.

Now referring to FIG. 2, plow bottom 18 is comprised of moldboard 20, shin 22 and share 24. Each portion of moldboard 18 is designed to perform a specific function. For example, share 24 is primarily responsible for cutting the furrow from the earth and controlling the width and the depth of the furrow cut. Shin 22 functions to direct the furrow so that it is presented properly to moldboard 20. In some designs, shin 22 is integral to moldboard 20. Moldboard 20 serves to upwardly and laterally displace the furrow in a manner which causes the furrow to roll, thereby achieving proper tilling action.

An important aspect of a moldboard's function is its ability to scour. Scour can generally be defined as the action of the furrow soil as it moves across the moldboard working surface 26 during plowing. When the furrow soil moves across working surface 26 of moldboard 20 without sticking thereto, the moldboard is said to be properly scouring. When the moldboard is properly scouring the furrows are properly turned and moldboard plow 10 produces the desired consistent, uniform furrow patterns. On the other hand, when the moldboard does not scour properly, plow 10 cannot operate to produce uniform, consistent furrows and accordingly, cannot be used until proper scouring action is obtained.

Improper scouring can be a result of any number of conditions some of which include, improper land speed, rusted or otherwise improperly maintained moldboards, mismatch between plow bottom design and soil conditions, etc.

It is generally accepted that some form of surface treatment is necessary to promote scouring upon initial use of a newly manufactured moldboard. In order to enable a newly manufactured moldboard to scour properly upon first use, it is conventional for manufacturers to directionally sand moldboard 26 thereby placing generally parallel surface scratches, exemplified at 28, across working surface 26 of moldboard 20. Directional surface scratches 28 are placed in working surface 26 in a manner intended to approximate the path taken by the furrow as it moves across the moldboard working surface 26 during actual plowing operation. It is well known, however, that the furrow does not uniformly move in "parallel" across working surface 26 of moldboard 20, but rather tends to run somewhat vertically across moldboard 20 in the area of shin 22 and somewhat horizontally in the vicinity of wing 23. After moldboard 20 is used, friction between the earth and the moldboard removes the directional surface scratches 28 placed on moldboard 20 during the manufacturing operation and polishes surface 26 giving it what is commonly referred to as a "land polish" (or working polish). The land polish directly reflects the path taken by the furrow at each point on working surface 26 of moldboard 20, thereby presenting minimum friction to the furrow during plowing.

Although placing surface scratches 28 along the working surface 26 of moldboard 20 is a means of promoting initial scouring until a sufficient land polish can be developed, it is not without its drawbacks. For example, the process by which moldboard blanks are directionally sanded is a costly one, due primarily to the capital investment in equipment which is necessary to automate this process, the time necessary to conduct the directional sanding and the process steps which must necessarily precede the directional sanding in order to properly prepare the moldboard blank.

The method of the present invention eliminates the aforementioned cleaning, straightening and sanding steps associated with the prior art method of producing moldboard blanks. The process of the prior art will be briefly explained in conjunction with FIG. 3, followed by the process and product of the present invention which is detailed in FIG. 4.

Figure 3:
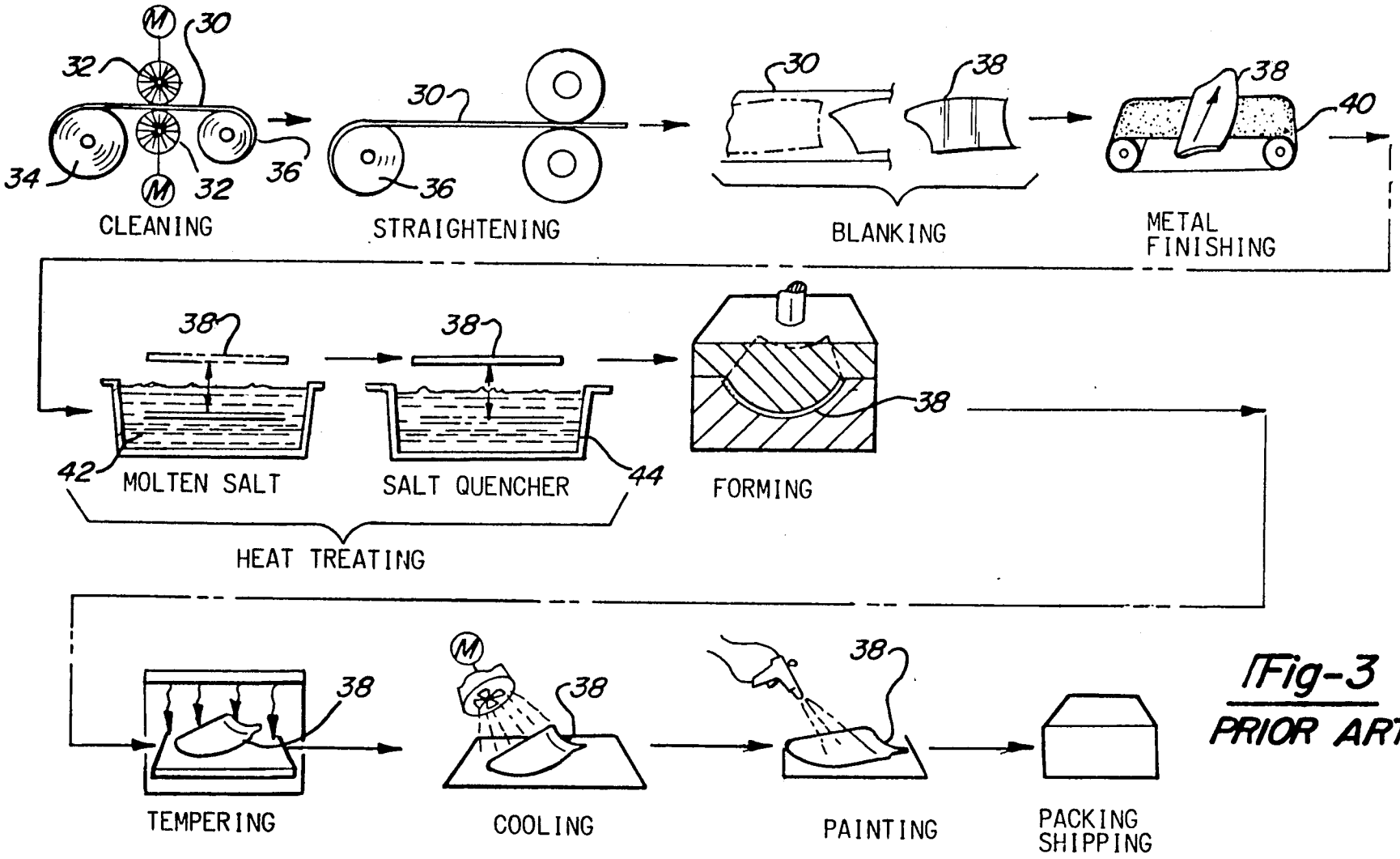
Fig-3 PRIOR ART
FIG. 3 is a process flow chart diagrammatically depicting each significant stage of the prior art process for making moldboards.

Now referring to FIG. 3, sheet metal stock or metal article 30, preferably ferrous metal, is scuffed or otherwise surfaced cleaned by way of brushes 32. Sheet metal 30 is depicted as metal which is rolled from spool 34 through the brushing process and onto spool 36. Although this is one manner in which the process of the prior art has been achieved, flat metal sheets of predetermined length have also been used as the initial stock which is brought in and brush cleaned. Also, other cleaning methods such as chemical or abrasive (i.e. sand blasting have been used. The primary purpose of this cleaning operation is to remove any iron oxide (commonly referred to as mill scale), oil or other contaminants which would later interfere with the directional sanding process.

After finishing the cleaning operation, metal 30 is transferred from spool 36 through a pair of rollers or other equivalent means for generally straightening metal 30. This process is necessary in order to achieve a consistent finish across metal 30 during the metal finishing step. The operation then proceeds to the blanking stage whereby the moldboard blanks 38 are stamped or otherwise produced from metal 30. Blanks 38 are then directionally sanded by belt sander 40, or the like, to impart onto working surface 26 (not shown) of blank 38 parallel surface scratches in the direction intended to approximate the direction in which the furrow will traverse the working surface of moldboard blank 38 during use. Before explaining the remainder of the prior art process, it is important to note that the first, second and fourth processing steps described in conjunction with FIG. 3 are replaced by one process step in the present invention. This translates into a measurable cost and time savings not only with regard to the capital investment necessary to purchase the equipment to conduct these three prior art steps, but also in the associated maintenance and time required to conduct these steps.

After completing the metal finishing step, blank 38 undergoes a heat treating process whereby it is first placed in molten salt bath 42 (for austenitizing blank 38). After the expiration of a predetermined period of time, blank 38 is removed from molten salt bath 42 and placed in salt quench bath 44 for a predetermined period of time. The process of heating and quenching metal to achieve a predetermined hardness is well known to those skilled in the art, and accordingly, the details of such processing are not elaborated upon herein.

From the heat treating operation, blank 38 is transferred to the forming operation whereby a die or similar apparatus is used to alter the contour of blank 38 from that of a relatively flat plate to a contour suitable for moldboards.

After the forming operation, moldboard 38 is transferred to a tempering stage to reduce some of the hardness which was created during the heat treating operation. Tempering is a well known technique in the art to condition hardened metals against cracking or breaking. Should the moldboard design contemplate mounting the moldboard to the plow frame via bolts, any bolt holes (not shown) placed through the moldboard are preferably annealed, after the tempering process, to resist against cracking. Moldboard 38 is then cooled, painted, packed and shipped whereby the product eventually makes it way into the marketplace. Painting or other surface treatment is generally a necessary step to preserve the metal finish placed on moldboard 8 during the metal finishing (directional sanding) stage. That is, as mentioned previously, even though working surface 26 of moldboard 20 was directionally sanded during the metal finishing stage, any rust or other contamination of moldboard 38 between the time it leaves the manufacturing facilities to the time it is placed in the ground could affect its ability to scour. By treating working surface 26 of moldboard 20 with a coating, working surface 26 is generally protected against contamination until it is first used.

Figure 4:
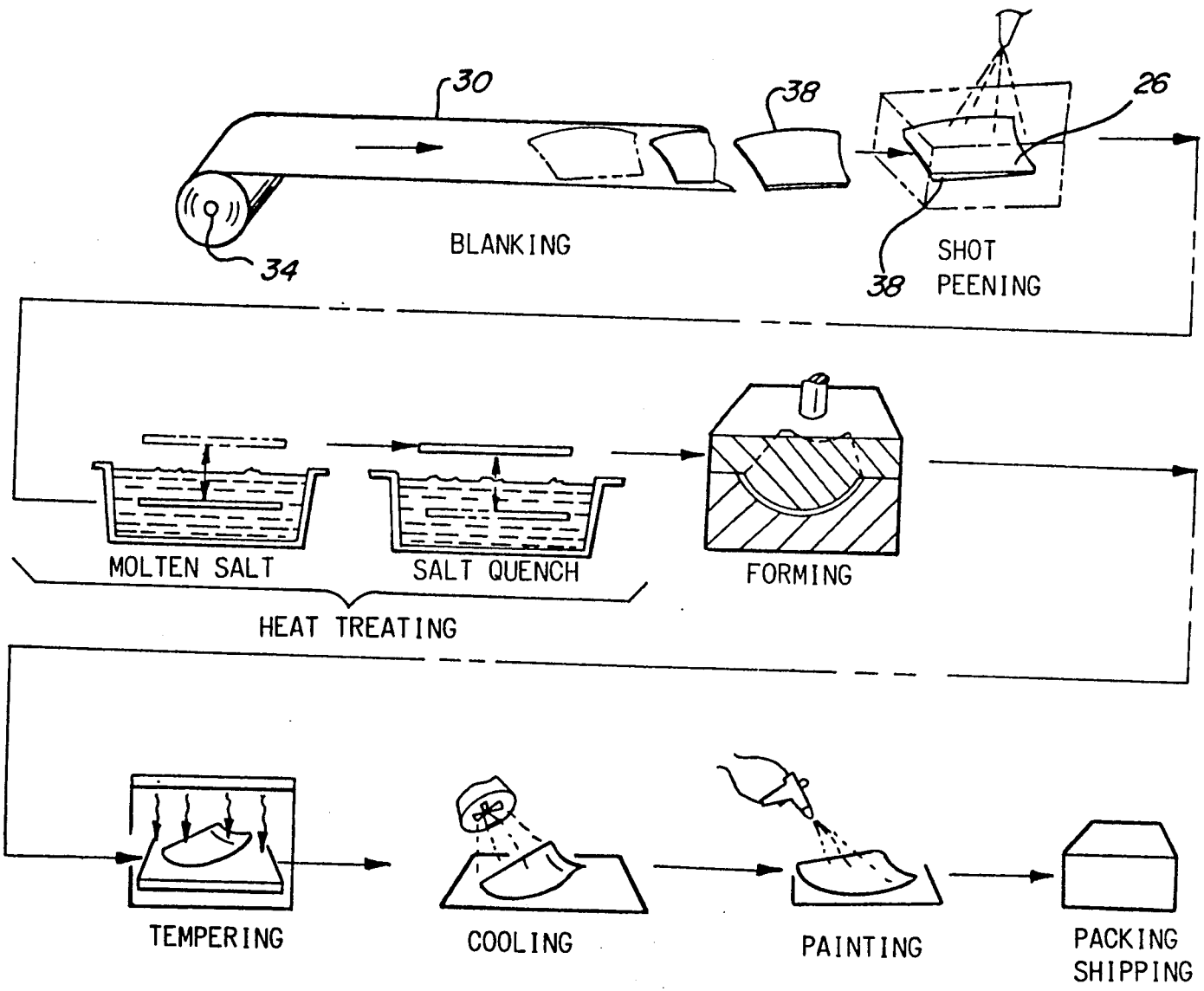
FIG. 4 is a process flow chart diagrammatically depicting each state of the present invention for making moldboards.

Now referring to FIG. 4, as previously stated, the process of the present invention allows the first, second and fourth process steps of the prior art to be reduced into a single step. More specifically, the cleaning, straightening and metal finishing step of the prior art are replace-d by one step (shot peening) as shown in FIG. 4. Accordingly, metal 30 provided via roll stock or the like, and is operated on at a blanking stage to produce moldboard blanks 38. This step is not changed from that of the prior art; however, moldboard blank 38 is then delivered to a shot peening operation whereby, under closely controlled conditions, working surface 26 of moldboard blank 38 is disrupted, or plastically deformed, thereby forming a controlled surface roughness and texture across working surface 26. The remaining process steps, namely heat treating, forming, tempering, cooling, painting and packing/shipping are all identical to that discussed above in the prior art and do not need to be further elaborated upon here. Because the shot peening operation plays a pivotal role in the disclosed method, its details will now be disclosed.

As stated, in the prior art process steps of cleaning, straightening and the sanding, several results are achieved. First, mill scale and other contaminants are removed in the cleaning process. Second, the metal stock is flattened in the straightening process. Third, in the metal finishing process the decarburization layer is removed and the resultant surface is directionally sanded. It is generally thought beneficial to achieve the above results for the following reasons. As will be appreciated by those skilled in the art, it is generally desirable to remove mill scale from the metal stock to prevent the contamination of the metal finishing and heat treating equipment. Importantly, mill scale also slows down the quenching rate thereby negatively affecting the hardness of the body. It is necessary to flatten the stock to ensure that the working surface of the moldboard is uniformly sanded. Finally, uniform sanding in the approximate direction of scouring produces surface scratches which facilitate initial scouring of new blades. Directional sanding also removes the soft decarburized layer from the metal blank. Therefore, it is apparent why the prior art processes of cleaning, straightening and finishing are conducted--they all facilitate, directly or indirectly, the directional sanding process which was believed, until now, to be necessary to promote initial scouring of the moldboard until a sufficient working (or land) polish could be achieved.

Although the exact mechanism is not fully understood, in the present invention the process of shot peening working surface 26 produces a moldboard with excellent initial scouring characteristics. This eliminates the need to directionally sand the moldboard thereby also eliminating the need to straighten the stock. The present, invention also eliminates the need to clean the metal, since scale and the like are readily removed or disrupted during the shot peening process. Shot peening, unlike sanding, is not sensitive to scale contamination. Although the exact reasons for its excellent scouring capability upon first use, are not fully understood at this time, several theories have been put forth which will now be explained in conjunction with FIGS. 5 and 6.

Figure 5:
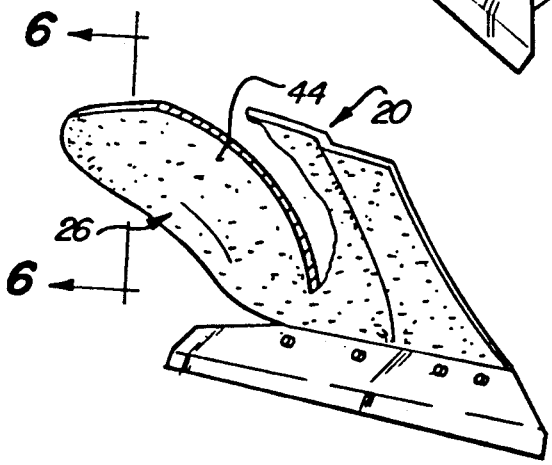
FIG. 5 is a plow bottom having a moldboard produced using the disclosed process.

Now referring to FIG. 5, the process of the present invention produces moldboard 20 having a surface roughness and texture 44 which can generally be described as a pocked surface having a series of peaks and valleys. The valleys are preferably defined by a series of concave, generally hemispherical indentations and the peaks are defined by the material displaced by a piece of generally spherical shot as it collides with working surface 26 of moldboard 20 to create the hemispherical indentations. In other words, "craters" are formed in the surface of moldboard 20 by the shot peening operation with the preferred method.

Figure 6:
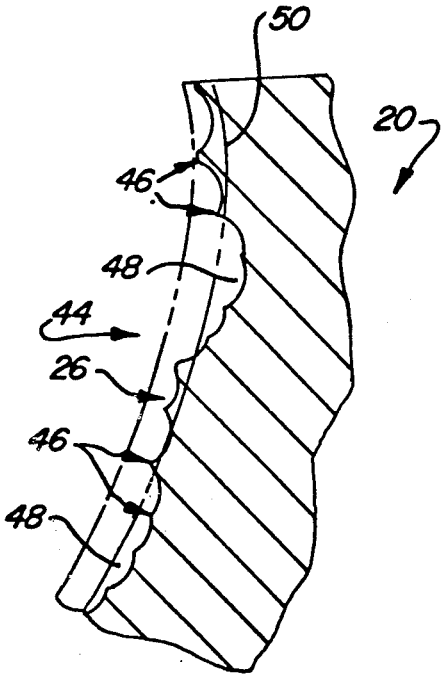
FIG. 6 is a cross-sectional view of the moldboard of the present invention taken substantially along line 6—6 of FIG. 5.

Now referring to FIG. 6, a diagrammatic microscopic cross-section of moldboard 20 of the present invention shows the roughness and texture 44 of working surface 20 having spaced peaks 46 and spaced valleys 48, as produced by shot peening. In a preferred embodiment, peaks 46 are generally uniform in height and valleys 48 are generally uniform in depth. Peaks 46 can generally be defined as the portions of working surface 26 which represent localized maximums and valleys 48 can be defined as the portions of working surface 26 which represent localized minimums. Imaginary line 50 coincides generally with the original surface line of moldboard 20 prior to the peening operation. The topography shown in FIG. 6 of working surface 26 is consistent with the shot peening operation which consists of impacting working surface 26 of moldboard 20 with spheres of hardened material such as shot.

Upon initial inspection, it may appear that working surface 26 as depicted in FIG. 6 would be incapable of scouring upon first use, since the cavities formed by peaks 46 and valleys 48 would appear to resist furrow movement thereby causing the furrow to stick to working surface 26 of moldboard 20. However, initial testing has shown that work surface 26 scours well upon first use as will be more fully explained hereinafter.

One theory used to explain the success of the shot peened moldboard 20 is that during the shot peening process, which eliminates the mill scale, the shot which strikes moldboard 20 in the areas which form valleys 48 essentially moves most of the surface layer, typically an oxide rich or decarburized layer, from the valley area into a neighboring peak 46 area. This in effect thins the undesirable surface in the area of valleys 48 and moves the material toward the peak areas thereby concentrating the surface layer in the peak areas 46. As the initial plowing takes place, the earth fills up valleys 48 first and, once valleys 48 are filled, the earth travels across surface 26 essentially supported on peaks 46. Under this theory, because peaks 46 typically have less carbon, they are generally softer than the remaining portion of moldboard 20 and wear away more quickly. This rapid wearing away of peaks 46 initiates and fuels the scouring process thereby quickly providing an initial scouring mechanism until a good land polish can be established on a surface of the underlying hardened body material. In contrast to this theory, initial microphotographs of a cross section of a moldboard manufactured by the disclosed process, appear to show no appreciable migration of the decarburized material from the valleys to the peaks. It appears that the decarburized layer runs generally parallel to peened surface 44.

A second theory advanced to explain the excellent initial scouring characteristics of the shot peened moldboard of the present invention is centered upon the geometry created by the shot peening process. In this alternative theory, the peaks form, in essence, the predominant contact points for the furrow as it travels across the working surface of the moldboard. Because the furrow is supported predominantly across the peaks, a sufficiently high unit pressure is created on the peaks to wear them down (or perhaps deform them) thereby forming a localized plane to support initial scouring. This process takes place across the most pronounced peaks and continues until the friction of the furrow against the moldboard works to achieve a land polish. Along the same line, it is theorized that the random arrangement of the peaks offer the additional advantage of not presenting any "directional resistance" to the flow of the furrow, thereby allowing the furrow to initially score or break-in the moldboard at every point along its working surface, in precisely the direction in which it will ultimately be land Polished. This is in contrast to the prior art directionally sanded moldboard which had a finish which only approximated the movement of furrow soil across the working surface of the moldboard. Thus, in the prior art, friction is created in the moldboard areas in which this approximation poorly matches actual earth movement, thereby sacrificing some degree of initial scouring capability.

In order to create the pocked, textured surface defined by peaks 46 and valleys 48, the following procedures have been established and have produced satisfactory results. Shot size in the range of S230 through S330 (as defined by Steel Founders Society of America standard specification for cast steel abrasives SFSA Designation 20-66) has been preferred, with a most preferred shot size of S280. A Pangborn blast cleaning device, Model No. GN-1M, was used to conduct the shot peening operation. This is a multi-head unit having a 3,000 lb. shot storage capacity and capable of impelling 1,500 lbs. of shot per minute. The motor which powers the multi-head impeller is set to draw 20–25 amps during the shot blasting process. Moldboard blanks 38 are of the nominal dimension of 0.312 inches thick, 18 inches wide and 32 inches long and are passed through the shot peening machine at a rate of one moldboard blank every 1.5 minutes.

It was discovered early in the development of the shot peening process that superior results were obtained when little or no broken shot was recirculated. Consequently, all broken shot is preferably removed during operation to ensure that it is not propelled against the moldboard blank. Additionally, it is also preferred that the size distribution of the shot follow a "normal" (also known as Gaussian) distribution. For S280 shot the test used to monitor this condition proceeds as follows. After approximately 70 hours of use, a 100 ml sample of shot is passed through a series of stacked screens having different size openings, as listed below.

SCREEN TEST

| Screen Number | Size (inches) | Acceptance Volume (cumulative) |
|---|---|---|
| 16 | .0469 | 0% |
| 18 | .0394 | 5% (max) |
| 20 | .0331 | Immaterial |
| 25 | .0280 | 90% (min) |
| 30 | .0232 | 96% (min) |
| PAN | — | Immaterial |

The above screen is comprised of rectangular openings; the dimensions of one side of each rectangle are given above. One hundred milliliters of shot is poured into the upper most screen (screen no. 16) and the screen assembly is vibrated for approximately five minutes to allow the shot sample to sift down, and be caught by, the appropriate screen mesh. After this five minute period has ended, the contents of each screen is removed and measured volumetrically and the percent of the shot sample which has been retained is calculated and summed to the Previous cumulative percentage. The shot distribution is at the preferred level if it follows the distribution set forth under the above acceptance column. More specifically, preferably none of the shot should be retained by screen no. 16, and preferably no more than 5% of the total sample shot should be retained by screen no. 18. No specific percentage is monitored for the contents of screen no. 20, and no less than 90% of the shot should be contained in screen nos. 16–25 and no less than 96% of the shot should be retained by screen nos. 16–30. The shot which escapes any of the screens, is caught by the bottom pan. A percentage count is not taken of the contents of the pan. Of course, other methods may be devised whereby the shot distribution is monitored and controlled, thereby controlling the disruption caused to working surface 26 of moldboard 20. Good success has been achieved with moldboards which exhibit a roughness height measurement in the general range of 240 through 310 RMS and most preferably generally 275 RMS as defined by American Standard Terms relating to surface finish-the American Standard (B 46.I-1955). Currently, a maximum surface roughness is not preferably allowed to exceed 310 RMS.

The detailed description herein of a method of forming a disrupted or pocked surface by shot peening is intended to describe the most preferred method presently known to the applicants and to enable a person of ordinary skill in the art to make and use the invention. It is believed, however, that other means may be found to disrupt the surface layer or remove the mill scale, particularly when the improved scouring using a roughened or pocked surface is more fully understood. Various other impact methods or other roughening methods may be found to be suitable or even preferred for forming the preferred roughened or pocked surface.

As presently understood, the method and earth working implement of this invention may utilize medium to high carbon steel. Good results have been obtained to date using the following grade of steel to form moldboard 20. Former SAE No. 1572 modified steel has been found to be most preferably used with the following special requirements: fully killed fine grain, 0.65–0.75% carbon, 1.28–1.48% manganese, 0.015% max. sulphur, sulfide inclusion shape controlled to yield a minimum of 80% globular sulfides, with percentages given in weight percent (except globular sulfides given in volume percent). The blanks are marquenched and tempered to achieve a body (i.e., below the decarburized layer) Rockwell surface hardness in the range of 47–51 and a Rockwell body through hardness of a minimum of 47. Of course it is recognized that other materials may also perform satisfactorily, such as laminate steel, carburized steel and the like. Other heat treating techniques may also be suitable, or even preferable, in some applications.

From the foregoing, it is apparent that the process and apparatus of the present invention are useful in various applications where it is desired to produce ground tillage equipment capable of scouring. It is recognized, of course, that those skilled in the art may make various modification or additions to the illustrated embodiments chosen here to illustrate the invention, without departing from the spirit and the scope of the present invention. For example, the present invention is not limited to the manufacture and use of moldboard plows, but may be applicable to many forms of earth tillage equipment such as cultivator sweeps, field cultivator points, grain drill shovels and the like. Accordingly, it is understood that the protection sought to be afforded hereby should be deemed to extend to the subject matter claimed herein and all equivalents thereof fairly within the scope of the invention.

I claim:

1. A method of making a metal earth working implement, comprising the steps of:

(A) disrupting an earth working surface of a metal article by shot peening said surface to form a controlled surface roughness across said surface, (B) hardening said metal article having said controlled surface roughness, and (c) forming said metal article into said earth working implement, wherein said roughened surface of said metal article forms an earth working surface.

2. The method of claim 1, wherein said method further comprises the step of cutting said metal article from a sheet to produce sheet metal blanks.

3. The method of claim 1, wherein said method further comprises the steps of tempering said hardened metal article.

4. The method of claim 1, wherein said shot peening is conducted to achieve a surface roughness in the general range of 240–310 RMS.

5. The method of claim 1, wherein said shot peening step further comprises shot peening using shot in the general range of S230 through S330.

6. The method of claim 1, wherein said shot peening step further comprises shot peening without using broken shot.

7. The method of claim 1, wherein the size distribution of said shot generally follows a Gaussian distribution.

8. The method of claim 1, wherein said hardening of step (B) further comprises the steps of:

immersing said metal article having said controlled surface roughness into molten salt for austenitization, and quenching said metal article having said controlled surface roughness.

9. The method of claim 1, wherein step (C) follows both steps (A) and (B).

10. The method of claim 1, wherein said forming of step (C) further comprises the step of:

forming said metal article in a die.

11. The method of claim 1, further including the steps of:

(D) placing said metal implement in an earthen environment it is designed to be used in, and (E) working said earth across said roughened surface of said implement to achieve a working finish.

12. A method of making earth working implements which scour, said implements being formed from metal stock having at least one earth working surface, comprising the steps of:

(A) disrupting said earth working surface of said metal stock by shot peening said surface to form a predetermined surface roughness and texture across said earth working surface, said predetermined surface roughness and texture being sufficient to enhance the souring capacity of said metal stock, (B) heat-treating said metal stock having said predetermined surface roughness and texture to harden said metal stock, and (C) forming said hardened metal stock into the shape of an earth working implement, wherein said roughened and textured earth working surface of said metal stock forms a scouring surface on said implement adapted to directly contact and work said earth.

13. The method of claim 12, wherein said method further comprises the step of cutting said metal stock from metal sheets to produce sheet metal blanks.

14. The method of claim 12, wherein said method further comprises the steps of tempering said hardened metal stock.

15. The method of claim 12, wherein said shot peening is conducted to achieve a surface roughness in the general range of 240–310 RMS and a surface texture generally resembling craters.

16. The method of claim 12, wherein said shot peening step further comprises shot peening using shot in the general range of S230 through S330.

17. The method of claim 12, wherein said hardening of step (B) further comprises the steps of:

immersing said shot peened metal stock having said controlled surface roughness into molten salt for austenitization, and quenching said shot peened metal stock having said controlled surface roughness.

18. The method of claim 12, wherein step (C) follows both steps (A) and (B).

19. The method of claim 12, wherein said forming of steps (C) further comprises the steps of:

forming said metal stock in a die.

20. The method of claim 12, further including the steps of:

placing said formed metal implement in the earth, and moving said implement relative to said earth such that the earth moves across said roughened surface of said implement to achieve a working finish.

21. A method of producing moldboards for use on moldboard plows, said moldboards of the type produced from metal stock having at least one surface which is sufficiently depleted of carbon so as to normally prevent adequate hardening of said surface, comprising the steps of:

(A) disrupting said carbon depleted surface of said metal stock by shot peening said surface to form a controlled surface roughness on said carbon depleted surface.

(B) hardening said metal stock having said controlled surface roughness on at least one surface thereof, (C) forming said stock into the desired moldboard configuration suitable for plowing, wherein said roughened surface is adapted to be an earth working surface of said moldboard.

22. The method of claim 21, further comprising the step of, (D) working the earth with said moldboard wherein said earth is passed across said earth working surface thereby scouring said earth working surface to produce a working finish on said surface.

23. The method of claim 21, further comprising the step of blanking said moldboards from a metal sheet.

24. The method of claim 21, further comprising the step of tempering said hardened metal stock.

25. The method of claim 24, wherein said tempering step takes place after said forming step (C).

26. The method of claim 21, wherein said disrupting of step (A) further comprises the steps of:

shot peening said depleted carbon surface of said metal stock to achieve surface roughness in the range of 240 through 310 RMS.

27. The method of claim 26, wherein said shot peening step includes shot peening using shot in the general range of S230 through S330.

28. The method of claim 21, wherein said hardening of step (B) further includes the steps of:

austenitizing said shot peened metal stock in a bath of molten salt, and quenching said heated shot peened metal stock in a bath of salt, wherein said heating and cooling processes harden said metal.

29. The method of claim 28, wherein step (B) precedes step (C).

30. The method of claim 21, wherein said forming of step (C) further comprises the steps of:

forming said metal stock in a forming die whereby said metal is formed into its working contour.

31. A method of forming a relatively smooth, friction resistant, contoured, earth working surface on a ferrous metal agricultural implement, said method comprising the steps of:

heat treating ferrous metal stock to be used to form said implement, plastically deforming a surface of said ferrous metal stock by shot peening said surface forming spaced peaks and spaced valleys, deforming said ferrous metal stock and contouring said surface to form an earth working surface to form an earth working contour, whereby said earth working surface is easily worked in a ground working application to scour said contoured surface, removing said peaks and exposing said valleys thereby forming said relatively smooth, friction resistant contoured surface.

32. The method of claim 31, wherein said spaced peaks are of substantially uniform height.

33. The method of claim 31, wherein said spaced valleys are of substantially uniform depth.

34. A method of forming an earth working implement consisting essentially of the following steps performed in sequence:

(a) cutting a blank from sheet metal stock, (b) disrupting an earth working surface of said blank forming randomly distributed peaks and valleys, (c) heat treating said metal blank having said disrupted surface, (d) deforming said blank into a contoured shape with said disrupted surface contoured for earth working, and (e) tempering said contoured metal blank.

35. The method of making a metal earth working implement as defined in claim 34, wherein said earth working surface is disrupted to a surface roughness in the range of 240 to 310 rms.

36. The method of forming an earth working implement as defined in claim 34, wherein said heat treating step includes the steps of:

austenitizing said disrupted metal surface in a molten salt bath, and quenching said disrupted metal surface in a salt quench bath.

37. The method of forming an earth working implement as defined in claim 34, wherein said earth working surface is disrupted by shot peening said earth working surface of said blank.

38. The method of forming an earth working implement as defined in claim 37, wherein said shot peening step comprises shot peening said surface using shot in the general range of S230 through S330.

39. The method of forming an earth working implement as defined in claim 37, wherein said shot peening step comprises shot peening with substantially unbroken metal shot.

* * * * *